US007798744B2

(12) United States Patent
Larson et al.

(10) Patent No.: US 7,798,744 B2
(45) Date of Patent: Sep. 21, 2010

(54) SEAL COAT PROCESS UTILIZING MULTIPLE APPLICATIONS OF ASPHALT BINDER AND AGGREGATE

(75) Inventors: Larry Larson, Broken Arrow, OK (US); John Domichel, Cottonwood, UT (US)

(73) Assignee: Road Science, L.L.C., Tulsa, OK (US)

( * ) Notice: Subject to any disclaimer, the term of this patent is extended or adjusted under 35 U.S.C. 154(b) by 441 days.

(21) Appl. No.: 11/872,468

(22) Filed: Oct. 15, 2007

(65) Prior Publication Data

US 2009/0097918 A1 Apr. 16, 2009

(51) Int. Cl.
*E01C 19/21* (2006.01)

(52) U.S. Cl. ..... 404/82; 404/17; 404/31; 404/101; 404/108

(58) Field of Classification Search ..... 404/17, 404/27, 31, 82, 101, 108
See application file for complete search history.

(56) References Cited

U.S. PATENT DOCUMENTS

| | | | | | |
|---|---|---|---|---|---|
| 2,220,149 | A | * | 11/1940 | Finley | 404/82 |
| 2,925,831 | A | * | 2/1960 | Welty et al. | 138/141 |
| 3,970,403 | A | * | 7/1976 | Goyer et al. | 404/27 |
| 4,818,139 | A | * | 4/1989 | Brock et al. | 404/81 |
| 5,000,615 | A | * | 3/1991 | Murray | 404/75 |
| 5,069,578 | A | * | 12/1991 | Bense et al. | 404/75 |
| 5,234,128 | A | * | 8/1993 | Hill | 222/63 |
| 5,269,626 | A | * | 12/1993 | Soliman et al. | 404/108 |
| 5,279,500 | A | * | 1/1994 | Perrin et al. | 404/75 |
| 5,439,313 | A | * | 8/1995 | Blaha et al. | 404/75 |
| 5,590,976 | A | * | 1/1997 | Kilheffer et al. | 404/72 |
| 5,735,634 | A | * | 4/1998 | Ulrich et al. | 404/102 |
| 6,386,818 | B1 | | 5/2002 | Reed | |
| 6,776,557 | B2 | | 8/2004 | Barnat et al. | |
| 6,805,516 | B2 | | 10/2004 | Barnat et al. | |
| 6,918,714 | B2 | * | 7/2005 | Chambard | 404/82 |
| 2002/0182009 | A1 | | 12/2002 | Barnat | |

FOREIGN PATENT DOCUMENTS

| | | |
|---|---|---|
| EP | A0879648 | 11/1998 |
| FR | A2626593 | 8/1989 |
| JP | 2001323409 | 11/2001 |

* cited by examiner

*Primary Examiner*—Raymond W Addie
(74) *Attorney, Agent, or Firm*—Head, Johnson & Kachigian, P.C.

(57) ABSTRACT

This invention relates to a novel seal coat process and equipment for applying the seal coat to improve the reliability of seal coat aggregate retention to the surface of the pavement by increasing the surface area of aggregate covered with binder and interlocking the aggregate with finer gradation material such as choke stone. It also relates to the use of lower amounts of asphalt binder, lower amounts of aggregate application, lower quality of aggregates, use of softer binders, and faster release to traffic times.

18 Claims, 10 Drawing Sheets

SEAL COAT PROCESS UTILIZING MULTIPLE APPLICATIONS OF ASPHALT BINDER AND AGGREGATE

BACKGROUND OF THE INVENTION

1. Field of the Invention

The present invention relates to a surface treatment for a paved surface and the equipment for applying the asphalt binder and aggregate to accomplish this treatment. More specifically, the present invention is a seal coat process that uses substantially synchronous multiple applications of asphalt binder and aggregate in a single pass of the equipment over a road surface.

2. Description of the Related Art

Asphalt concrete deteriorates over time through the effects of air and water damaging the flexibility of asphalt cement and the bond of asphalt cement to the aggregate in the asphalt concrete mix. To delay the damaging effects of air and water, surface treatments are placed on top of asphalt concrete to seal the voids. This decreases the exposure of the asphalt binder in the asphalt concrete to air and water.

One of the most common and cost effective surface treatments is known as a chipseal. A chipseal involves spraying an asphalt binder (usually asphalt emulsion but can be asphalt cutbacks or hot asphalt cement) from a distributor truck onto the surface of the pavement. Soon after application of the asphalt binder to the road surface, aggregate is applied by a chip spreader vehicle.

While the most cost effective seal coat available, chipseals can have problems keeping the aggregate adhered to the road. Loose aggregate causes significant windshield damage, and many agencies have discontinued the use or restricted the use of chipseals to low traffic count roads. The main cause of premature aggregate loss is due to low embedment of the aggregate into the asphalt binder. There are multiple variables which contribute to low aggregate embedment including, but not limited to, irregular existing asphalt pavement texture, rock dimension changes, weather, delay in getting the rock applied to the asphalt binder, and traffic load. Another cause of low aggregate embedment is excess dirty fines coating the aggregate and not allowing it to adequately bond to the asphalt binder.

The obvious solution to aggregate loss in chipseals would be to increase the amount of asphalt binder applied to the existing pavement surface to increase embedment. However this approach creates a "bleeding" problem where the asphalt binder is pushed to the surface of the chipseal causing a rich asphalt surface. A "bleeding" or "flushing" chipseal deteriorates the aesthetics of the chipseal as well as potentially lowering the skid resistance of the finished chipseal.

Other attempts have been made to improve aggregate retention. The methods tried to date include precoating the aggregate with asphalt binder before shipping it to the construction site, applying choke stone after the chipseal is constructed to attempt to interlock the chipseal aggregate, and the use of fog seal applications several days after the chipseal is constructed to add extra asphalt to the surface. These approaches have shown improvement in aggregate retention. However, better methods of providing a surface treatment to a surface are still needed.

Also, paving vehicles for applying the asphalt binder and aggregate in a single pass of the vehicle have been employed, such as the paving vehicle which is the subject of U.S. Pat. No. 6,805,516 by James J. Barnat et al. and which is incorporated herein by reference. This patent teaches a roadway paving system and paving vehicle for applying a single layer of asphalt binder and thereafter applying a single layer of aggregate in a single pass with the paving vehicle in continuous fashion without driving on the freshly paved surface. By applying the aggregate to the layer of asphalt binder shortly after the binder is applied to the roadway, aggregate retention is improved. Also because both the binder layer and aggregate layer are applied in a single pass of the paving vehicle behind the rear wheels of the vehicle, the layers of binder and aggregate are not disturbed by the tires of the paving vehicle.

This type of paving vehicle needs to be continually supplied with binder and aggregate as it operates. Thus, specialized supply trucks, such as the one taught in U.S. Pat. No. 6,776,557 by James J. Barnat et al., are required to supply binder and aggregate to this type of paving vehicle as the paving vehicle is operating. The teachings of both U.S. Pat. No. 6,805,516 and U.S. Pat. No. 6,776,557 are incorporated herein by reference.

However, it would be desirable to be able to apply multiple layers of binder and aggregate in a single pass of a paving vehicle. Also, it would be desirable if the layers of binder thus applied could be of two different types of binder material. Further, it would be desirable if the layers of aggregate thus applied could be of two different types of aggregate material. The present invention addresses this need by providing a paving vehicle and supply truck and method for applying multiple layers of asphalt binder and aggregate in a single pass of the paving equipment over a roadway.

SUMMARY OF THE INVENTION

The present invention is a pavement surfacing process that uses substantially synchronous multiple applications of asphalt binder and aggregate. In the process of the present invention, normally a first portion or layer of the normal asphalt binder content is placed on the road surface, followed by application of aggregate, followed by a second portion or layer of asphalt binder being applied over the surface of the aggregate, followed by a second layer of aggregate in a substantially continuous fashion. The binder employed for the second layer may or may not be the same binder material used in the first layer. Normally the second layer of aggregate applied to the roadway is different from the first layer of aggregate, although it is possible to use the same type of aggregate for both first and second layers. Preferably, a finely graded material, choke stone, or sand is distributed over the second layer of binder as the second layer of aggregate, which helps to prevent the second layer of asphalt binder from being picked up by tires rolling over the surface.

Although the process of the present invention, normally applies a first layer of the binder, followed by first application of aggregate, followed by a second layer of binder, followed by a second layer of aggregate, it is not so limited. Instead, the process of the present invention can omit the first layer of binder and simply apply a first application of aggregate, followed by a single layer of binder, followed by a second layer of aggregate.

Having a significant percentage of the total asphalt binder sprayed on top of the aggregate in the second layer or as a single layer increases the surface area of the aggregate that is coated by asphalt. This increases aggregate retention, allows lower application rate of aggregate, and allows for potentially higher fines content aggregate. By using this process in a one step application, lower aggregate content than used in a normal one layer chipsealing process can be used. This allows for faster return of traffic to the treated surface.

Other objectives and advantages of the invention will become more apparent from the following detailed description when taken in conjunction with the accompanying drawings.

DETAILED DESCRIPTION OF THE PREFERRED EMBODIMENT

Figure 1:
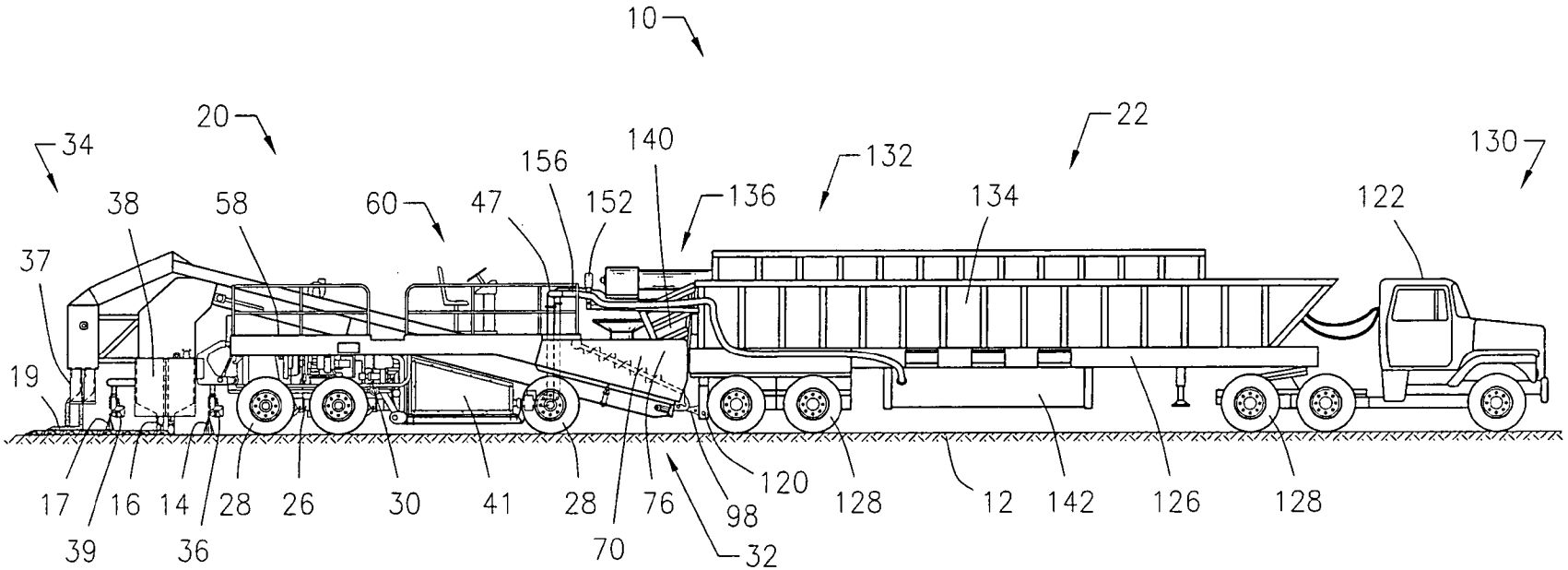
FIG. 1 is right side elevation view of a roadway paving system according to a preferred embodiment of the present invention comprising a roadway paving vehicle and a supply truck.

Referring now to the drawings, and initially to FIG. 1, there is illustrated an improved surface treatment for a road surface. In a preferred embodiment of the present invention, the process of applying this surface treatment includes applying a portion of asphalt binder on a surface, then applying aggregate to the binder, and then applying the remaining asphalt binder so as to substantially cover the aggregate. A finely graded material then may be placed on the second layer of binder.

The asphalt binder may be an asphalt emulsion, asphalt cutback, liquid asphalt, molten bituminous material, hot asphalt cement, or another type of binder. Preferably, the asphalt binder is prepared as an asphalt emulsion. Most preferably, it is a polymer modified asphalt emulsion. Typically chipseal grade binders may be used, or alternatively, higher needle penetration asphalts may be used. Preferably, the binder can be an asphalt emulsion. More preferable, the asphalt emulsion is prepared as a cationic rapid set emulsion. Most preferably, the asphalt emulsion has a viscosity of at least about 50 Saybolt Furol seconds (SFS) at 50° C. The binder is applied at a rate in a sufficient amount to adhere the aggregate to the surface. Preferably, the binder is applied at a rate of about 0.1-1.0 gallons per square yard. For a particular size of aggregate, the rate of emulsion application can be up to approximately 20% by volume less than in a traditional chipsealing processes.

The aggregate can be any traditional aggregate made from limestone, granite, or other rock. It may be obtained from gravel or crushed stone. Typically, it will range in size from about 0.25-0.75 inches. Preferably, a maximum of 3% passes through a 200 mesh sieve. Preferably, a minimum of 80% is retained on a #4 sieve. It is further contemplated that the aggregate may, but need not, be precoated aggregate. The aggregate is applied at a rate of about 5-50 pounds per square yard, depending on the size of the aggregate. The rate of aggregate application can be up to approximately 30% by weight less than in traditional chipsealing processes. Typically, it will be at least about 20% less. This will amount to up to about 30% less aggregate by weight being used than used in a typical one layer chipseal process.

The remaining asphalt binder is applied as a second layer of binder. The total amount of binder used is proportional to the amount of aggregate applied in the first aggregate layer. It may, but need not have, the same composition as the first layer of binder. One or both layers may, but need not, be polymer modified. However, by providing a first binder and a second binder with different characteristics, surfaces that meet particular needs can be made. For example, the first layer of binder can have a higher needle penetration value than the second layer of binder. This could provide a soft layer that receives aggregate while still providing good structural support to receive traffic.

The total amount of binder used in the surface treatment of the present invention is substantially less than a traditional double chipsealing process. Preferably, less than 80% of the binder used when two layers of traditionally sized aggregate are applied is used in the present invention. Most preferably, the amount of asphalt used in both binder layers is no more than what is used in a single layer chipseal. The top layer of binder should be about 20-80% by volume of the total amount of binder used. Preferably, at least about 25% by volume of the total amount of binder used is on the top layer. Preferably, no more than about 60% by volume of the total binder used is on the top layer. More preferably, at least about 35% by volume of the total amount of binder used is on the top layer. Most preferably, the top layer of binder is about 45-55% by volume of the total amount of binder used.

It is desirable but not required to place a finely graded material on top of the second layer of binder. This layer can be used to blot excess asphalt, allowing for quicker return to traffic than treatments that have a top coating of aggregate (not finely graded) or binder. This helps to keep tires from disturbing the first layer of aggregate. Adding a layer of finely graded material on top of the second layer of binder also accelerates coalescence by absorbing moisture. If a finely graded choke stone or other finely graded aggregate is used, then this will be the second layer of aggregate applied. Preferably, a finely graded choke stone is placed on top of the second layer of binder. Alternatively, sand or other finely graded material may be used in place of choke stone. More specifically, the finely graded material should have at least about 50% passing through a ¼ inch sieve and a maximum of about 15% passing through 200 mesh. Preferably, at least about 75% of the finely graded material passes through a ¼ inch sieve, and most preferably, at least about 95% of the finely graded material passes through a ¼ inch sieve. If a finely graded choke stone or other finely graded aggregate is used, only a small amount of the total amount of aggregate used is a part of the second layer, unlike a traditional double chipseal. Typically, about 10-30% by weight aggregate of the total amount of aggregate is used in the final layer. Most preferably, about 15-20% by weight aggregate of the total amount of aggregate is used in the final layer. A finely graded material placed over the second layer of asphalt binder may help to reduce tires tracking in the asphalt binder.

It is further contemplated, as another aspect of the present invention that using a substantially synchronous process, 2 layers of binder and 2 layers of aggregate could be applied even if the second layer of aggregate was not finely graded. The present invention includes performing multiple chipsealing processes in less than 24 hours, preferably in less than 12 hours, and most preferably as a substantially synchronous and continuous process.

Another aspect of the present invention is a three layer substantially synchronous process that includes applying aggregate, followed by applying binder, followed by applying a layer of finely graded material. It is also contemplated to have a four layer synchronous process where additional binder is applied on top of the finely graded material layer. Still another aspect of the present invention involves applying binder, followed by aggregate, followed by finely graded material in a substantially synchronous process.

Figure 8:
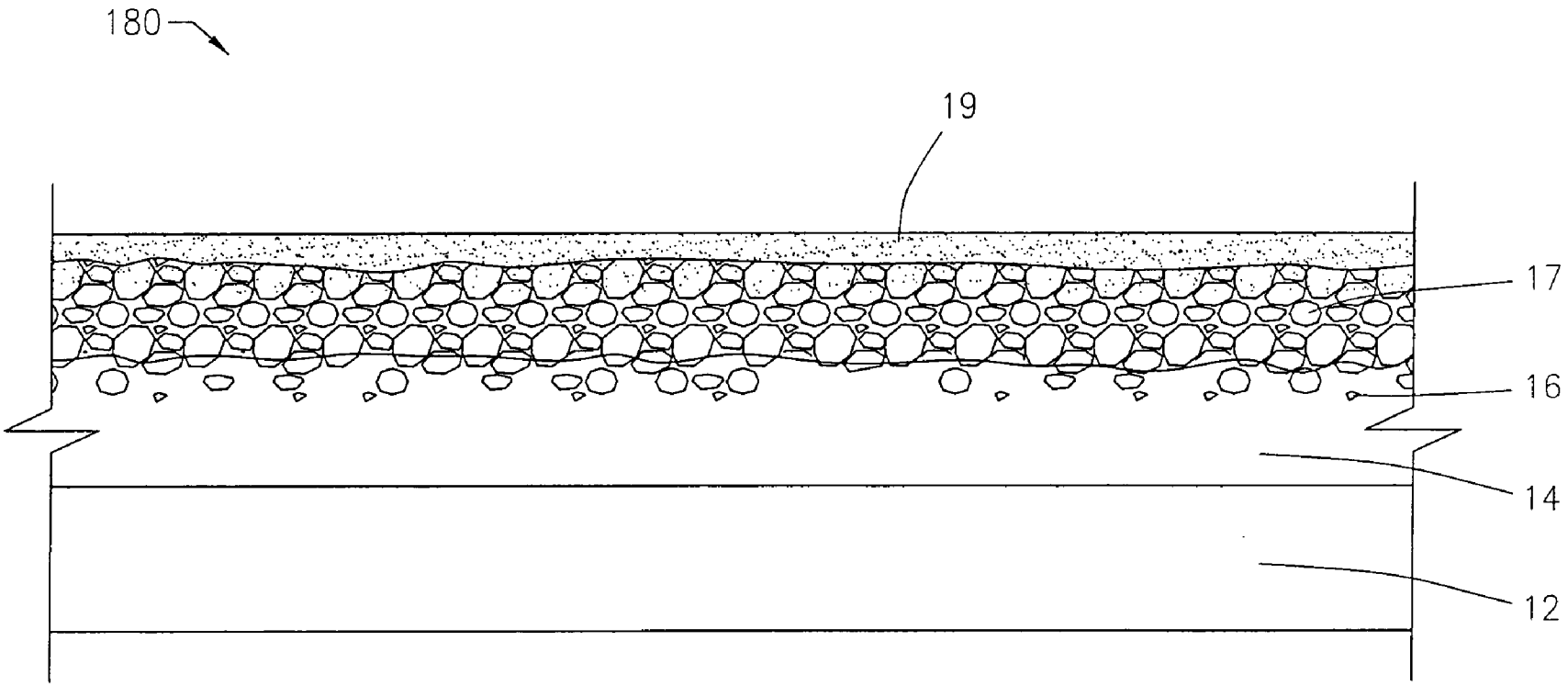
FIG. 8 is a cross-sectional view of the treated road surface of the present invention.

A treated road surface resulting from the process described above is another aspect of the present invention. A road surface having a preferred surface treatment of the present invention is shown in FIG. 8 and is broadly designated by reference numeral 12. This surface treatment includes applying a first layer of binder 14 on road surface 12, a first layer of aggregate 16, a second layer of binder 17, and a second layer of finely graded aggregate or choke stone 19. As illustrated in FIG. 8, second layer of binder 17 substantially covers aggregate 16. When aggregate 16 is distributed on binder 14, it is somewhat or partially imbedded in binder 14. Additional binder 17 then substantially covers aggregate 16 so that the road surface is a layer of aggregate imbedded in binder.

In making the treated road surface of the present invention, the first layer of aggregate 16 should be placed on the first layer of binder 14 before it substantially coalesces. Preferably, the first layer of aggregate 16 is placed within about 2 hours of the application of the first layer of binder 14. Most preferably, the first layer of aggregate 16 is placed within about 1 hour of the application of the first layer of binder 14. Typically, the first layer of aggregate 16 is placed within less than a minute of the application of the first layer of binder 14. In addition, the second layer of aggregate or other finely graded material 19 should be placed on the second layer of binder 17 before it substantially coalesces. Preferably, the second layer of aggregate or other finely graded material 19 is placed within about 2 hours of the application of the second layer of binder 17. Most preferably, the second layer of aggregate 19 is placed within about 1 hour of the application of the second layer of binder 17. Typically, the second layer of finely graded material 19 is placed within less than a minute of the application of the second layer of binder 17. Preferably, the second layer of binder 17 and the second layer of aggregate 19 are placed prior to the first layer of binder 14 substantially coalescing. Preferably, the second layer of binder 17 is applied to the first layer of aggregate 16 within about 24 hours. Preferably, all of the layers 14, 16, 17 and 19 are placed within about 24 hours. More preferably, all of the layers 14, 16, 17 and 19 are placed within about 12 hours. Even more preferably, all of the layers 14, 16, 17 and 19 are placed within about 6 hours. Most preferably, all of the layers 14, 16, 17 and 19 are placed in a substantially continuous and synchronous process.

Preferably, 3 layers, namely, binder, aggregate and remaining binder, are placed in a substantially synchronous process where the sprays have non-intersecting trajectories. Most preferably, 4 layers, namely, binder, aggregate, remaining binder, and finely graded material are placed in a substantially synchronous process.

The substantially continuous and synchronous process of the present invention may be accomplished by using a single piece of equipment capable of applying all layers in a single pass in a substantially synchronous manner. Alternatively, multiple distribution vehicles may be used. Preferably, the single piece of equipment is a vehicle that includes 2 spray systems and 2 aggregate dispensing systems. Preferably, this vehicle includes spray systems with independent control of distribution of the first layer of binder and the second layer of binder. This independent control allows the ratio of the first binder layer to the second binder layer to be adjusted at any time or to be completely turned off.

For purposes of illustration, a preferred embodiment of the present invention is illustrated as an asphalt paving system 10 comprising a roadway paving vehicle 20 and a supply truck 22 as shown in FIG. 1. The roadway paving vehicle 20 applies asphalt binder 14, aggregate material 16, remaining binder 17, and finely graded material 19 typically over an existing road surface 12, such as a roadway, to surface treat the road surface 12. It also could be used for new roadway surfaces or other road surfaces. The supply truck 22 carries two supplies of asphalt binder material 14 and 17, aggregate material 16, and finely graded material 19 for the purpose of refilling the roadway paving vehicle 20 with materials. In operation, the supply truck 22 links with the roadway paving vehicle 20 on the run. The phrase "on the run" means that the roadway paving vehicle 20 is moving forward and continuously dispensing asphalt binder materials 14 and 17, aggregate material 16, and finely graded material 19 while it is being refilled. This requires that the supply truck 22 be linked with the paving vehicle 20 so that the supply truck 22 and paving vehicle 20 can move together while the supply truck 22 is refilling the paving vehicle 20. After the supply truck 22 is empty, the supply truck 22 is disconnected from the roadway paving vehicle 20 and then the roadway paving vehicle 20 can then be linked with another supply truck (not illustrated).

The paving system 10 is primarily used to surface treat an existing road surface 12 with a first asphalt binder layer 14, an aggregate layer 16 spread on the top of the asphalt binder layer 14, a second asphalt binder layer 17, and a finely graded material layer 19. The layers 14, 16, 17 and 19 combine to create a new surface over the road surface 12 that provides a water barrier or seal, improves the life-span of the surface, provides for improved vehicle traction, and can also provide a new wearable layer. Although this disclosure describes four layers 14, 16, 17 and 19, it will be appreciated to those skilled in the art that once these layers 14, 16, 17 and 19 are deposited on a roadway surface, the layers typically combine integrally and are substantially indistinguishable from one another forming a single stratum of paving material.

Figure 2:
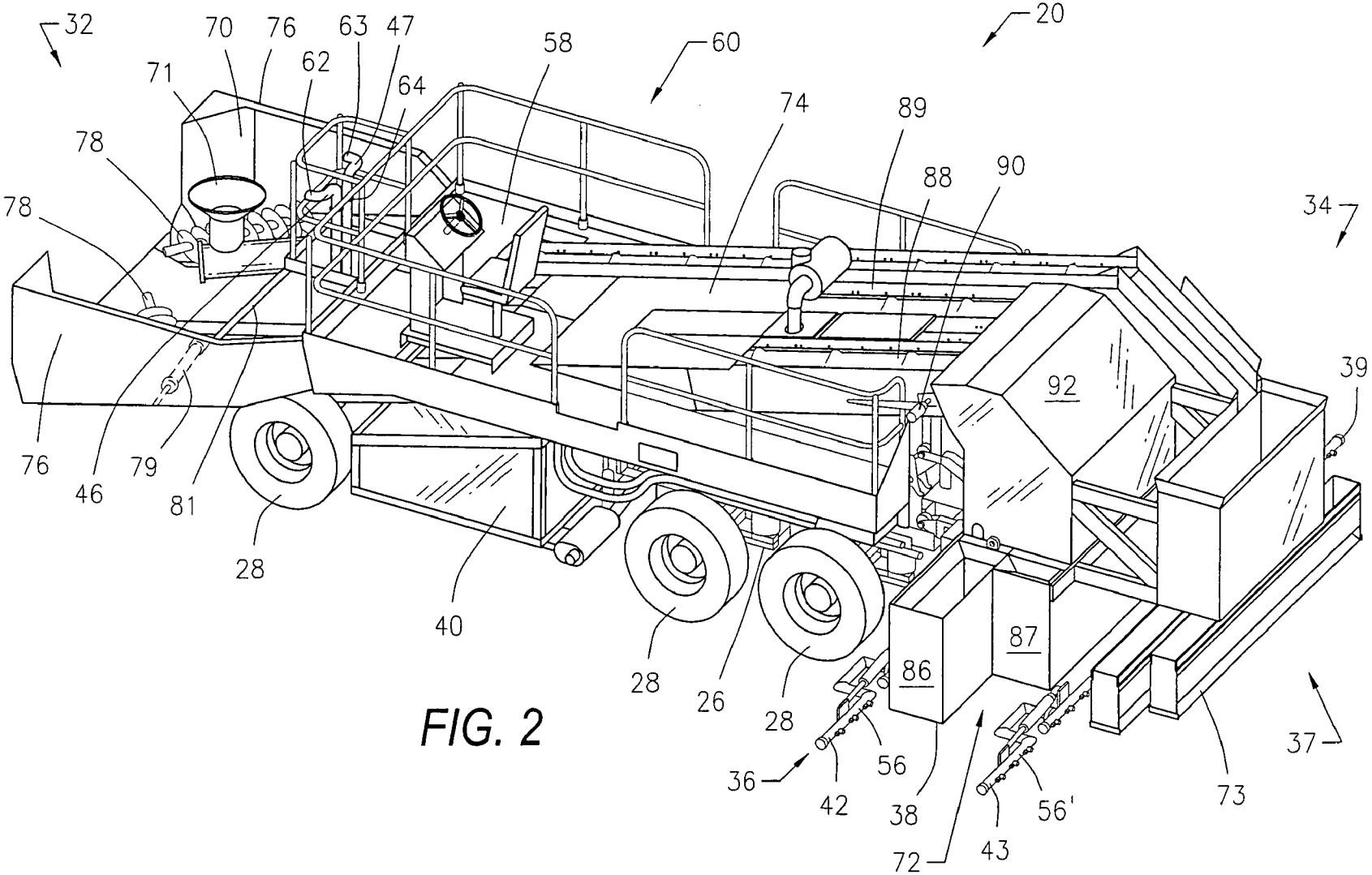
FIG. 2 is an enlarged isometric view of the roadway paving vehicle illustrated in FIG. 1 taken from the left side of the paving vehicle.
Figure 3:
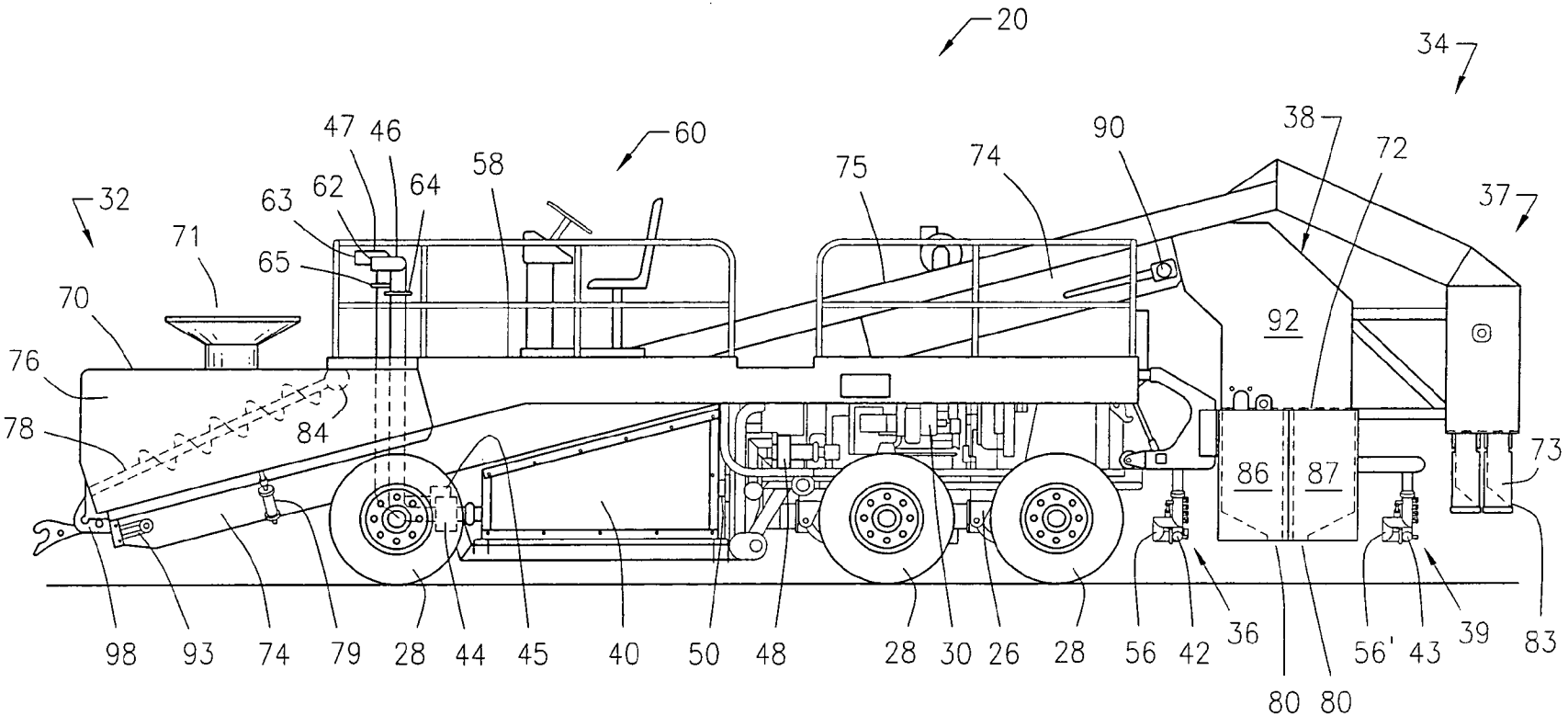
FIG. 3 is a side elevation view of the roadway paving vehicle illustrated in FIG. 2.

Referring to FIGS. 2-5, the roadway paving vehicle 20 comprises a frame or chassis 26 supported on wheels 28 and an engine 30. For purposes of reference, the vehicle 20 includes front and rear ends generally indicated at 32, 34. The vehicle 20 carries a first asphalt binder dispensing systems 36 that dispenses asphalt binder material 14, a first aggregate material dispensing system 38 that dispenses aggregate material 16, a second asphalt binder dispensing system 39 that dispenses binder 17, and a finely graded material dispensing system 37 that dispenses finely grade material 19. As generally shown in FIGS. 1 and 3, the asphalt binder dispensing systems 36 and 39 are separate from the aggregate material dispensing systems 38 and 37 such that asphalt binder materials 14 and 17 and aggregate materials 16 and 19 are not mixed in the vehicle 20 prior to the dispensing of the asphalt binder materials 14 and 17 and the aggregate materials 16 and 19 at the rear end 34 of the vehicle 20. Thus, the aggregate material 16 and 19 is discharged without being mixed with asphalt binder 14 and 17 inside the vehicle 20. By using a single vehicle 20 carrying both the asphalt binder dispensing systems 36 and 39 and the aggregate material dispensing systems 38 and 37, the time and spacing between application of the asphalt binder material 14 and 17 and aggregate material 16 and 19 can be optimized for best chip embedment and retention. In addition, the dispensing areas of the asphalt binder dispensing systems 36 and 39 and the aggregate material dispensing systems 38 and 37 are all arranged at the rear end 34 of the vehicle 20 behind all of the supporting wheels 28 such that the wheels 28 do not roll over freshly laid first asphalt binder layer 14, aggregate layer 16, second asphalt binder layer 17, and finely graded material layer 19. This prevents the wheels 28 from picking up and throwing stones or damaging the fresh application and may allow less aggregate to be used.

In the disclosed embodiment, the first asphalt binder dispensing system 36 generally comprises a tank 40, a spray bar 42, an input pump 44, an input conduit 46, an output pump 48 and an output conduit 50. The second asphalt binder dispensing system 39 also comprises a tank 41, a spray bar 43, an input pump 45, an input conduit 47, an output pump 49 and an output conduit 51. The tanks 40 and 41 are supported between front and rear sets of wheel 28, and each contains hot asphalt binder material 14 or 17. The tanks 40 and 41 are sized large enough to provide a sufficient holding capacity for dispensing asphalt binder material 14 or 17 on a continuous basis between changes in supply trucks 22 without the need to stop, thereby avoiding flaws or bumps in the roadway surface. The output pumps 48 and 49 are fluidly connected to the tanks 40 and 41, respectively, and the spray bars 42 and 43, respectively, to pump asphalt binder material 14 and 17 to the spray bars 42 and 43, to form sprayers. The particular disclosed pumps 48 and 49 are asphalt gear pumps which may both pump and meter asphalt binder material 14 or 17 directly. However, it will be appreciated that other pumps, such as tank pressurizing pumps could be used for example in conjunction with control valves, or other pumping schemes.

Figure 4:
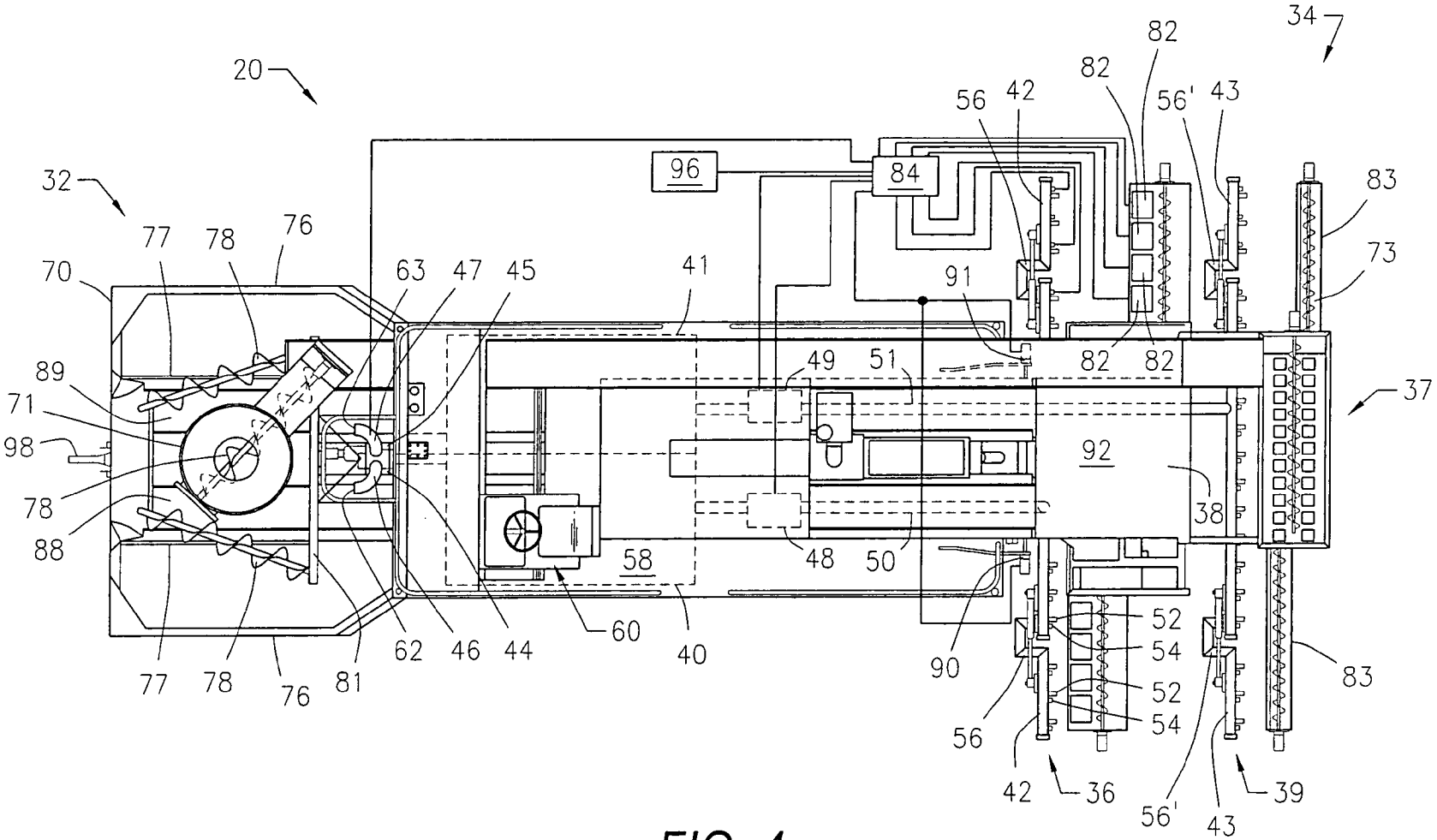
FIG. 4 is a top plan view of the roadway paving vehicle illustrated in FIG. 2 with a partial schematic added to illustrate operational features of the vehicle and with the input hopper for the finely graded aggregate removed for clarity.
Figure 5:
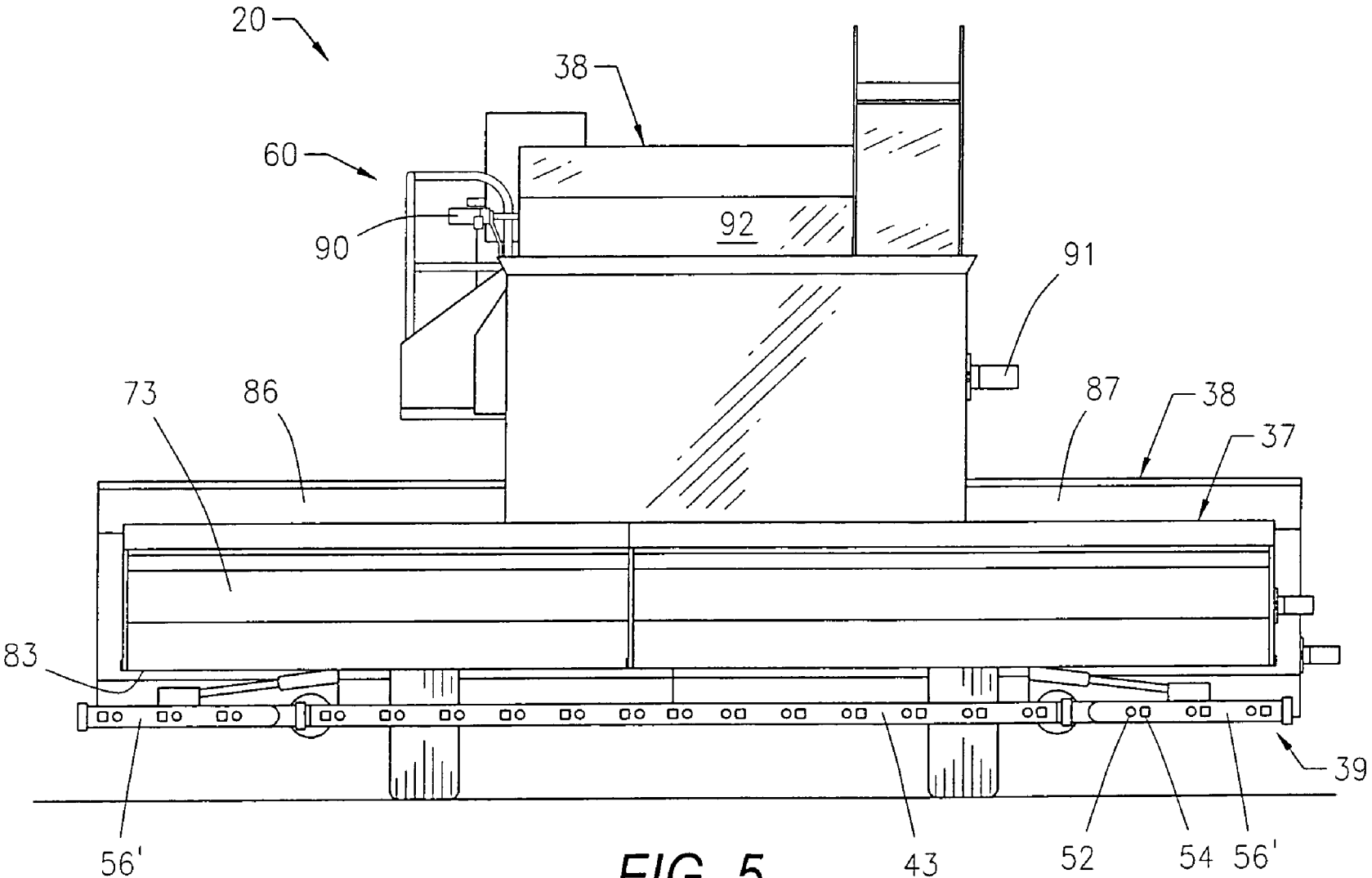
FIG. 5 is a rear end view of the roadway paving vehicle illustrated in FIG. 2.

The spray bars 42 and 43 extend horizontally generally parallel to the roadway surface 12. Referring to FIGS. 3, and 4, the spray bar 42 is comprised of a plurality of nozzles 52 and a plurality of control valves 54 in series with the nozzles 52. For clarity of illustration, not all control valves and nozzles or connections between control valves and nozzles are shown in FIG. 4. Each control valve 54 controls flow of asphalt binder material 14 to the individual nozzles 52. The control valves 54 have open and closed states for allowing and preventing flow of asphalt binder material 14 to individual nozzles 52. With this arrangement, the span or spray width of asphalt binder material 14 is selectively variable or modular and can be controlled or adjusted by shutting off selected control valves 54.

The spray bar 42 also preferably includes extendible and retractable arms 56, as best seen in FIG. 4. The arms 56 can extend beyond the normal width of the vehicle 20 so as to cover an entire roadway lane. The arms 56 can also retract to be within the normal width of the vehicle 20 for road transport. The extendible and retractable arms 56 are illustrated as the pivoting type, pivoting between raised and lowered positions, but it will be appreciated that horizontally extendible and retractable telescoping arms may also be utilized that extend horizontal with respect to the roadway 12.

The details of spray bar 43 are not shown but it is contemplated that spray bar 43 could have the same or similar features as spray bar 42 with regard to spray nozzles and control valves. Spray bar 43 is also provided with extendible and retractable arms 56', as best seen in FIG. 4.

The disclosed asphalt binder dispensing systems 36 and 39 also include refill systems comprised of the input conduits 46 and 47, respectively, and the input pumps 44 and 45, respectively, for pumping asphalt binder material 14 and 17 into the holding tanks 40 and 41, respectively, as shown best in FIGS. 3-4. Preferably the input pumps 44 and 45 are gear pumps that work through suction rather than pressure to avoid pressurized lines that could otherwise rupture. The input conduits 46 and 47 fluidly connect to the holding tanks 40 and 41, respectively, and extend vertically above a platform 58 of an operator station 60 on the vehicle 20 and terminate in hydraulic couplings 62 and 63, respectively. The hydraulic couplings 62 and 63 are disposed at a convenient vertical height for ready and accessible connection to the asphalt binder supply of the supply truck 22 by the operator stationed on the vehicle's operator station 60, as will become apparent when the supply truck 22 is discussed in more detail hereafter. The input conduits 46 and 47 preferably include swivel joints 64 and 65, including ball joints or other rotatable joints, respectively, allowing rotation about the vertical axis to allow an operator to connect the hydraulic couplings 62 and 63 to the supply truck 22. The input conduits 46 and 47 also extend vertically upwardly through the platform 58 in a centrally accessible location relative to conveyers 88, 89 discussed infra.

The aggregate material dispensing system 38 comprises a storage hopper in the form of an input hopper 70 at the front end 32 of the vehicle 20 and an output hopper 72 at the rear end 34 of the vehicle. The aggregate material dispensing system 38 further includes a conveyer mechanism 74 extending diagonally for transporting aggregate material from the input hopper 70 to the output hopper 72.

The hoppers 70, 72 are sized large enough to provide a sufficient holding capacity for dispensing aggregate material 16 on a continuous basis between changes in supply trucks 22 without the need to stop, thereby avoiding flaws or bumps in the roadway surface. The input hopper 70 may include extendible and retractable extension wings 76 that expand horizontally outward via a fluid powered cylinder outside the normal span of the vehicle 20 to increase the holding capacity of the input hopper 70 and retract within the normal span of the vehicle 20 for over the road transportation. In the disclosed embodiment, each of the wings 76 can be pivoted about hinges 77 by fluid powered cylinders 79 to provide the desired clearance. The disclosed embodiment also includes augers 78 disposed above the conveyer mechanism 74 and mounted between the input hopper 70 and a horizontal cross support 81 mounted to the chassis 26. The augers 78 or other such spreaders can be operated to spread out the aggregate material in the input hopper 70 to more fully utilize the holding capacity of the input hopper 70 and wings 76.

The output hopper 72 discharges aggregate material 16 through a discharge port 80 at the bottom thereof as shown best in FIGS. 2 and 3. The discharge port 80 is divided into separate adjacent sections by a plurality of gates 82 as schematically shown at the top of FIG. 4. For clarity of illustration, not all control valves and gates or connections between gates and control valves are shown in FIG. 4. The gates 82 have open and closed states for allowing and preventing discharge of aggregate material 16. The overall span or width of the applied layer of aggregate material 16 is determined by the gates 82, which can be opened and closed. More gates 82 can be opened to expand the span of discharged aggregate material 16 or closed to decrease the span of discharged aggregate material 16. Thus the length or span of the discharge port 80 is selectively variable or modular to accommodate different application widths and changes in the width of the roadway surface 12. In practice, the width of the discharged aggregate material 16 is typically equal to or just greater than the width of the discharged asphalt binder material 14. Aggregate material 16 may be discharged in a forward direction, a rearward direction or in both directions through the discharge port 80. The discharge port 80 may also be divided into multiple horizontally parallel sections with certain sections having a fixed output and other sections having a variable output.

The output hopper 72 is also divided into a pair of horizontally translatable dispensing bins 86, 87 disposed one in front of the other. The bins 86, 87 are contained within the normal span of the vehicle 20 for over the road transportation. However, the bins 86 and 87 expand through horizontal movement with respect to the roadway outside the span of the vehicle 20 to expand the overall length of the discharge port 80 sufficient to cover at least an entire lane of a roadway 12 and substantially equivalent to the length of the extended spray bar 42. The dispensing bins 86, 87 and the spray bar 42 can be shifted from side to side or right or left for adjustment as necessary as an offset or off-center feature.

As the output hopper 72 may be divided into separate bins 86 and 87 as in the disclosed embodiment, similarly, the conveyer mechanism 74 may comprise separate conveyers in the preferred form of endless belt conveyers 88 and 89 controlled by motors 90 and 91, respectively. Although belt conveyers 88 and 89 have been illustrated, it will be appreciated that other conveyer mechanisms could also be used, such as augers which may also have holding capacity for aggregate material if large enough. Each belt conveyer 88 and 89 feeds aggregate material 16 into the bins 86 and 87 through a guide chute 92. Each conveyer 88 and 89 can feed aggregate material 16 in both bins 86 and 87, or alternately, each conveyer 88 and 89 can be dedicated to one bin 86 or 87. The diagonal arrangement of the conveyers 88 and 89 allows for room for the operator station 60 and platform 58 to be at a relatively high vertical height towards the front end 32 of the vehicle. At the front end 32, the conveyers 88 and 89 have a relatively low vertical height. As the conveyers 88 and 89 extend rearward and upward, clearance is provided for the tanks 40 and 41 and engine 30 toward the center and rear end 34 of the vehicle 20 where the conveyers 88 and 89 are at a relatively high vertical height.

Figure 9:
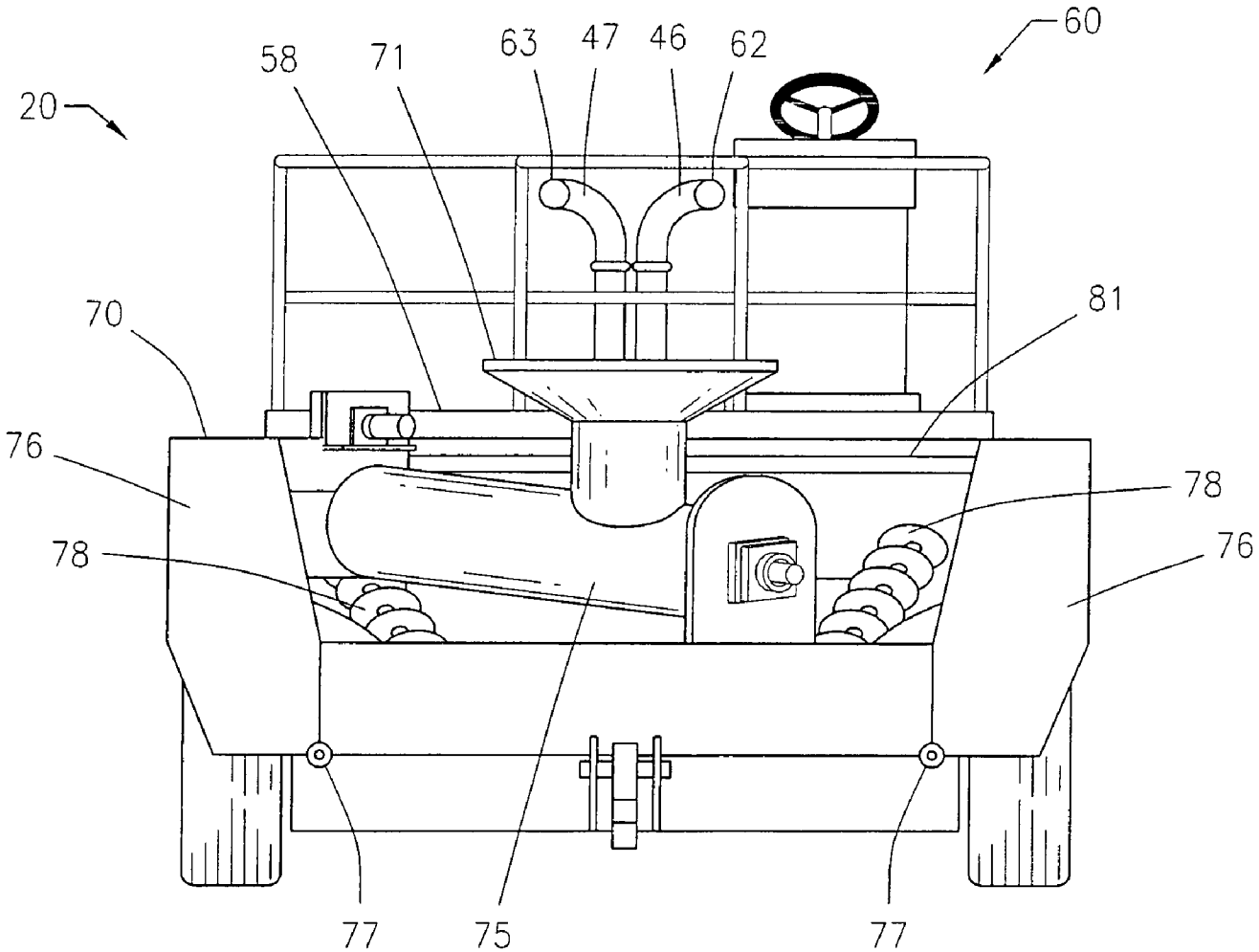
FIG. 9 is a partial front view of the roadway paving vehicle illustrated in FIG. 2 showing the two input hoppers.

Referring also to FIG. 9, the finely graded material dispensing system 37 comprises a storage hopper in the form of an input hopper 71 at the front end 32 of the vehicle 20 and an output hopper 73 at the rear end 34 of the vehicle. The input hopper 71 may be a separate hopper from input hopper 70 which may be located beside or above input hopper 70 or may be simply formed by a partition within input hopper 70 to separate the contents of the two input hoppers 70 and 71.

The finely graded material dispensing system 37 further includes a conveyer mechanism 75 extending diagonally for transporting finely graded material 19 from input hopper 71 to output hopper 73. The details of the finely graded material dispensing system 37 are not shown, but it is contemplated that this dispensing system could include some or all of the features of aggregate material dispensing system 38 which has previously been described or may be any other type of aggregate moving device, such as for example an auger type conveyer shown in FIG. 9.

The first spray bar 42 is generally parallel to the discharge port 80 and spaced in front of the discharge port 80 a distance of between about 0.1 and about 10 feet. The second spray bar 43 is generally parallel to discharge port 80 and is spaced behind the discharge port a distance of about 0.1 to about 10 feet. The discharge port 83 of the finely graded material output hopper 73 is spaced a distance of between about 0.1 and about 10 feet behind second spray bar 43. The roadway paving vehicle 20 applies asphalt binder material 14, aggregate material 16, additional asphalt binder material 17, and finely graded material 19 at a maximum sustainable speed of between about 1 and about 15 miles per hour. During truck refilling, the speed of the vehicle 20 may slow.

To accommodate different vehicle speeds, different application rates, and different widths and thickness of the layers 14, 16, 17 and 19 of asphalt binder and aggregate, the paving vehicle 20 includes an electronic controller 84, either as an integral controller or as several separate controllers, in electrical communication with the control valves 54, the output pumps 48 and 49, and the gates 82, as schematically indicated in FIG. 4. The electronic controller 84 is responsive to vehicle speed determined by a speed sensor 96 and other operator input. The electronic controller 84 controls these components to set an application rate and width for each asphalt binder material 14 and 17, the aggregate material 16, and finely graded material 19 from one of many of the various application rates and widths available. As the vehicle speed changes, the electronic controller 84 automatically compensates accordingly to produce uniform application.

To better prevent spilling of material 14, 16, 17, and 19 during supply truck 22 refilling operations, the roadway paving vehicle 20 also includes a mechanical coupling hook attachment 98 at the front end 32 that releasably couples to a cross bar 120 at the rear end 132 of the supply truck 22, as can be seen in FIGS. 1, 3, 4, 6, 6*a* and 7. This better ensures proper spacing between the roadway paving vehicle 20 and the supply truck 22. The truck 22 also preferably includes a truck spring impact mechanism 170 to absorb impact when the speeds of the truck 22 and roadway paving vehicle 20 are being synchronized when linking the truck 22 and paving vehicle 20 without stopping the forward progression of the chipsealing operation. The truck spring impact mechanism 170 allows the cross bar 120 to move forwardly against the action of a spring.

The roadway paving vehicle 20 similarly includes a vehicle spring impact mechanism 93 associated with the mechanical coupling hook attachment 98 for also absorbing impact. The vehicle spring impact mechanism 93 allows the hook attachment 98 to move rearward against the action of a spring. Although spring impact mechanisms 93 and 170 are illustrated, it will be appreciated that other shock absorbers may be used including silicon packing or other resilient members.

Turning in greater detail to the supply truck 22 with reference to FIGS. 1 and 6, 6*a*, and 7, the supply truck 22 is shown in the form of an over-the-road tractor 122 and a detachable live bottom trailer 124, although a unitary truck can also be used. The truck 22 includes a trailer chassis 126 supported on wheels 128 and extending longitudinally between front and rear ends 130, 132. The chassis 126 supports an elongated supply hopper 134 for holding aggregate material having a discharge region 136 at the rear end 132. The supply hopper 134 may hold traditionally sized aggregate for the first aggregate layer 16, finely graded material for the top layer 19, or combinations thereof with partitions in hopper 134 to keep the fines 19 from mixing with the coarse aggregate 16. A conveyer mechanism 138 in the supply hopper 134 can convey aggregate material 16 or 19 toward the discharge region 136.

Although only one conveyer mechanism 138 is illustrated, it may be desirable to have a second conveyer mechanism. The second conveyer mechanism may be similar in design to the first conveyer mechanism 138 or may be of any suitable design, such as an augur type conveyer. If two conveyer mechanisms 138 are provided, the first conveyer mechanism 138 would be employed to convey aggregate material 16 into input hopper 70 on the paving vehicle 20 and the second conveyer mechanism would be employed to convey finely graded material 19 into input hopper 71 on the paving vehicle 20.

Referring back to the drawings of the supply truck 22, a tailgate 140 closes the discharge region 136 of the supply hopper 134 to prevent material 16 and 19 from escaping and opens rearward to allow for material 16 and 19 to be discharged.

Figure 6:
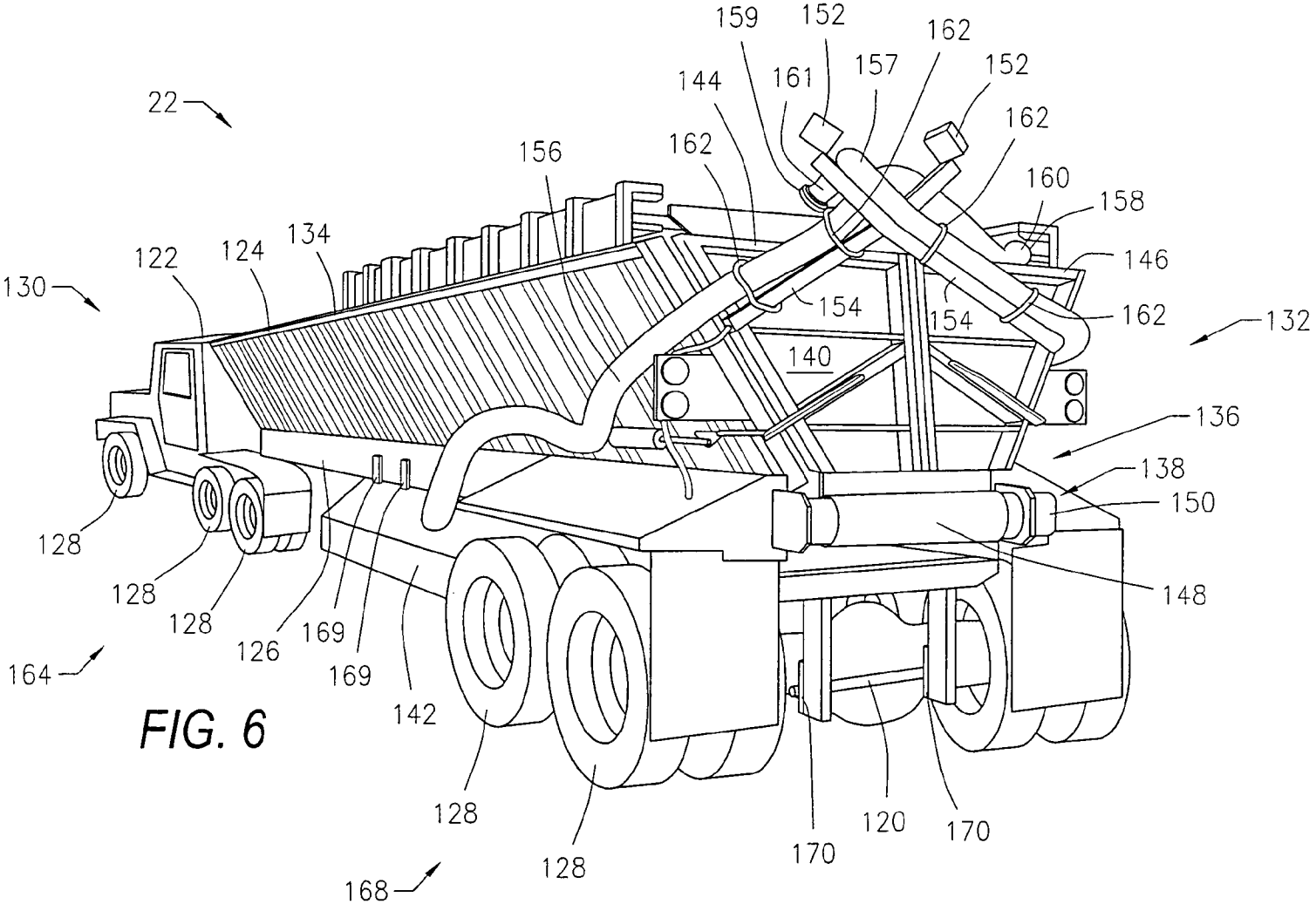
FIG. 6 is a rear end perspective view of the supply truck illustrated in FIG. 1, with the tailgate in a closed position.
Figure 6A:
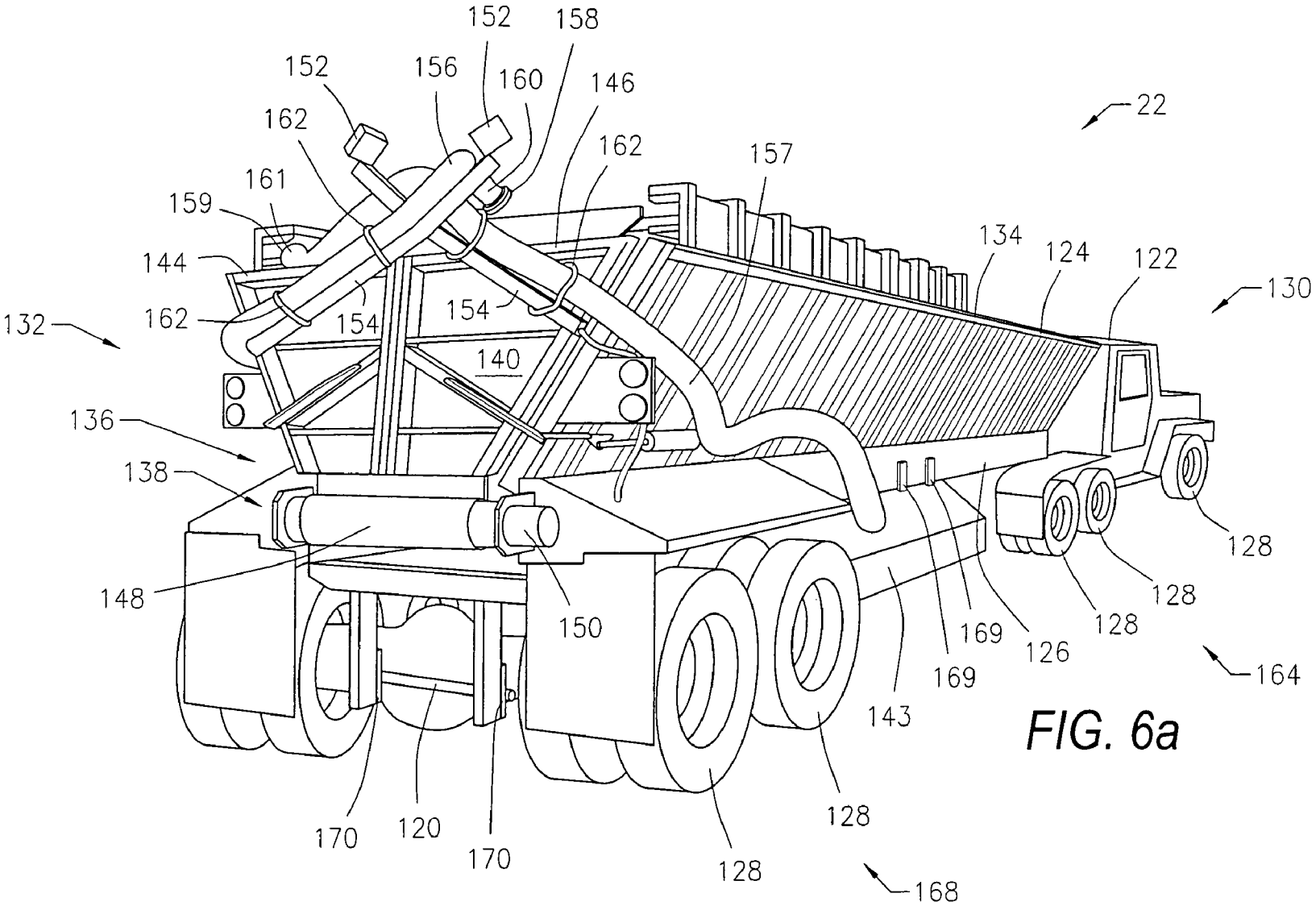
FIG. 6*a* is a rear end perspective view of the supply truck illustrated in FIG. 1, with the tailgate in a closed position and showing the opposite side from what is shown in FIG. 6.
Figure 7:
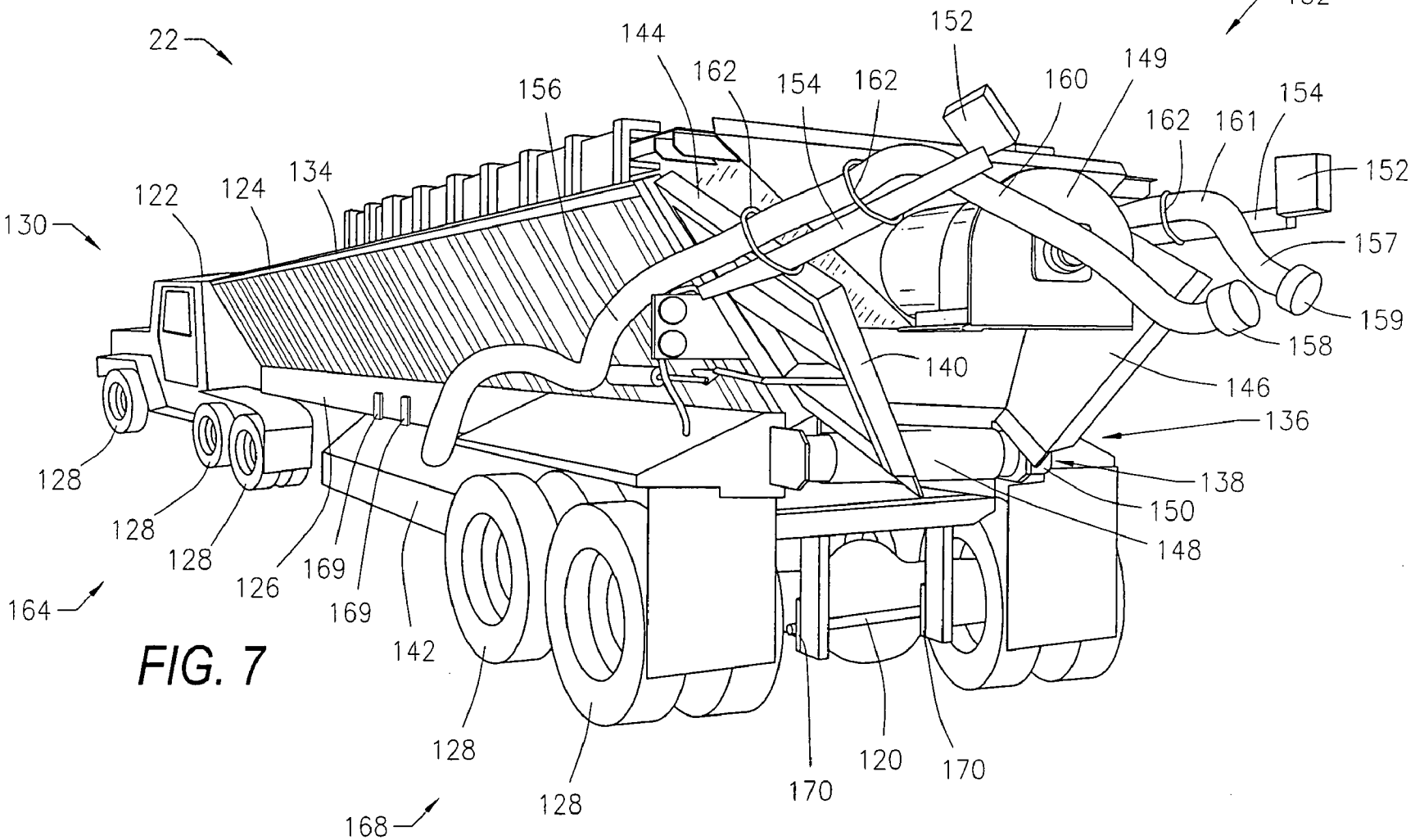
FIG. 7 is the same rear end perspective view of the supply truck shown in FIG. 6 but with the tailgate in an open position.

The supply truck 22 is also equipped with a first supply tank 142 containing asphalt binder material 14, as shown in FIG. 6, and optionally a second supply tank 143 containing a second type of asphalt binder material 17, as shown in FIG. 6*a*. Optionally, the second supply tank 143 can contain the same type of asphalt binder material 14 as contained in the first supply tank 142 if it is desired to apply only one type of asphalt binder material 14 to a roadway.

When the supply truck 22 and roadway paving vehicle 20 are linked together, aggregate material 16 can be transferred from the supply truck 22 to the input hopper 70 through the discharge region 136 and/or finely graded material 19 can be transferred from the supply truck 22 to the input hopper 71. The tailgate 140 is comprised of horizontally outwardly pivoting doors 144 and 146 that control and direct the discharge of aggregate material 16 and 19 from the supply hopper 134 of the truck 22. Further details of the outwardly pivoting doors are described in U.S. Pat. No. 6,386,818 by Michael F. Reed, the entire disclosure of which is hereby incorporated by reference. Suffice it to say that the doors 144 and 146 pivot rearward and away from each other to open the discharge region 136 and forwardly and toward each other to close the discharge region 136.

The supply truck 22 is illustrated as the "live bottom" type with the conveyer mechanism 138 comprising an endless belt 148 entrained around sprockets and driven by motor 150. The motor 150 has a variable speed such that the discharge rate of aggregate material 16 or finely graded material 19 is controllable. It is an aspect of the invention that the speed of motor 150 and therefore the conveyer mechanism 138 is controlled at the operator station 60 on the roadway paving vehicle 20. In the disclosed embodiment, this is accomplished with electronic control modules 152 of the supply truck 22 that extend to the paving vehicle 22. The control modules 152 are in electrical communication with the motor 150. In this manner, the refill rate of aggregate material 16 into the input hopper 70 and the refill rate of finely graded material 19 into input hopper 71 are controlled from the roadway paving vehicle 20. The operator of the paving vehicle 20 can control refilling and prevent an overfill condition as the input hoppers 70 and 71 are in clear sight of the operator of the paving vehicle 20 from the operator station 60 of the paving vehicle 20.

In the disclosed embodiment, the electronic control modules 152 are actually part of the supply truck 22. Specifically, the electronic control modules 152 are carried by the tailgate 140 of the supply truck 22 and extend rearward to the operator station 60 on the roadway paving vehicle 20 when the tailgate 140 opens rearward. More specifically, the electronic control modules 152 are carried on the end of support arms 154 affixed to the outwardly pivoting doors 144 and 146. The support arms 154 extend diagonally and upwardly positioning the electronic control modules 152 above the doors 144 and 146 so that when the doors 144 and 146 extend rearward, the electronic control modules 152 extend to the operator station 60 for ready access and use by an operator on the roadway paving vehicle 20.

Asphalt binder material 14 and 17 is transferred from the supply truck 22 to the roadway paving vehicle 20 via transfer conduits in the form of flexible transfer hoses 156 and 157. The flexible transfer hoses 156 and 157 have one end connected to the supply tanks 142 and 143, respectively, and the other end terminating in hydraulic couplings 158 and 159, respectively. When the tailgate 140 extends rearward, the flexible transfer hoses 156 and 157 and hydraulic couplings 158 and 159 also extend rearward to the operator station 60 for attachment with asphalt binder dispensing systems 36 and 39, respectively, of the roadway paving vehicle 20. In the disclosed embodiment, the transfer hoses 156 and 157 are supported by their associated support arm 154 and they extend beyond the end of the arm 154 to provide flexible end portions 160 and 161 for easy manipulation. The end portion 160 may be latched to the truck supply hopper 134 for transport. The transfer hoses 156 and 157 extend diagonally and upwardly generally parallel with support arms 154 being secured thereto by cables or chains 162. When the doors 144 and 146 extend rearward to open the discharge region 136, the transfer hoses 156 and 157 extend rearward to the operator station 60 for connection to the vertically extending input conduits 46 and 47, respectively. The hydraulic couplings 158 and 159 fluidly connect in a detachable manner to the hydraulic couplings 62 and 63, respectively, provided on the input conduits 46 and 47 of the roadway paving vehicle 20. Once connected, the input pumps 44 and 45 are operable to transfer asphalt binder 14 and 17 from the supply truck 22 to the paving vehicle 20 to refill the tanks 40 and 41, respectively.

A further aspect disclosed herein is that supply tanks 142 and 143 are disposed vertically beneath the conveyer mechanism 138 and the hopper 134 and between the front wheel set 164 and the rear wheel set 168 of the supply truck 22. The tops of the supply tanks 142 and 143 are mounted directly to the chassis 126 with brackets 169. This achieves a low center of gravity for the truck 22, particularly when the tanks 142 and 143 are full, and allows for a wider supply hopper 134 as opposed to use of side mounting tanks that would be mounted onto the side walls of the supply hopper 134.

In operation, the roadway paving vehicle 20 discharges asphalt binder material 14 and 17 and aggregate material 16 and 19 over the roadway 12 to surface treat the roadway surface. Specifically, the output pump 48 transfers asphalt binder material 14 from the tank 40 to the first spray bar 42 and out through the nozzles 52 to form the first asphalt binder layer 14. The output hopper 72 discharges aggregate material 16 through discharge port 80 to form an aggregate layer 16 over the asphalt binder layer 14. Output pump 49 pumps asphalt binder material 17 from tank 41 to the second spray bar 43, which distributes a second asphalt binder layer 17 over the aggregate layer 16. Then, output hopper 73 distributes finely graded material layer 19 on top of the second asphalt binder layer 17.

During operation, various retractable arms 56, control valves 54 and gates 82 can be selectively closed or opened in order to set the width or change the width of the surface treatment operation. This can be done without stopping the vehicle 20. In the event that the vehicle 20 incurs a change in speed, the electronic controller 84 can proportionally control the application flow rates of asphalt binder material 14 and 17 and aggregate material 16 and 19 to maintain uniform thickness of the layers 14, 16, 17 and 19. The flow rate of asphalt binder material 14 and 17 can be controlled by adjusting the speed of pumps 48 and 49 or the degree of opening of the control valves 54 in the spray bars 42 and 43, or both. The flow rate of aggregate material 16 from hopper 72 can be controlled by adjusting the degree of opening of the gates 82. Likewise, the flow of finely graded material 19 from hopper 73 can also be adjusted. The flow rates of aggregate material 16, finely graded material 19 and asphalt binder 14 and 17 may, but need not, be closely linked so as to increase and decrease in unison in order to maintain uniformity of the new treated surface formed from the operation of the present invention.

During operation, the roadway paving vehicle 20 uses its own internal supply of asphalt binder material 14 and 17 contained in the tanks 40 and 41. In addition, the conveyers 88 and 89 transport aggregate material 16 from the input hopper 70 to the output hopper 72, and conveyer 75 transports finely graded material 19 from input hopper 71 to output hopper 73. Eventually, the supplies of asphalt binder material 14 and 17, of aggregate material 16, and of finely graded material 19 contained in the vehicle 20 begin to run out. The supply truck 22 which carries a supply of both asphalt binder material 14 and 17 and aggregate materials 16 and 19 serves to refill these supplies for the roadway paving vehicle 22.

Advantageously, it is not necessary to back up a supply truck 22 as the supply truck 22 can be parked in front of the roadway paving vehicle 20 until the roadway paving vehicle 20 catches up with the stationary supply truck 22. The supply truck 22 then releasably couples with the roadway paving vehicle 20 while the roadway paving vehicle 20 continues to move forward and continues to discharge asphalt binder material 14 and 17 and aggregate material 16 and 19. This on the run coupling advantageously prevents bumps or flaws in the chipsealed roadway. Once coupled, the tailgate doors 144 open to allow aggregate material 16 and 19 from the truck hopper 134 to refill the input hoppers 70 and 71. When the doors 144 open, the transfer conduits 156 and 157 also automatically extends rearward toward the roadway paving vehicle 20. An operator on the roadway paving vehicle 20 can then couple the transfer conduits 156 and 157 to the input conduits 46 and 47. An operator can selectively operate the input pumps 44 and 45 to suction asphalt binder material 14 and 17 from the truck supply tanks 142 and 143, respectively, to refill the tanks 40 and 41, respectively, of the roadway paving vehicle 20. Opening of the doors 144 also extends the control modules 152 rearward to the roadway paving vehicle 20. An operator on the roadway paving vehicle 20 can use the control modules 152 to control the truck conveyers 148 and 149 and therefore the refilling rate of the input hopper 70 and input hopper 71. Conveyer 149 delivers aggregate to input hopper 71. As shown in the drawings, conveyer 149 is an auger type system that can be moved rearward to position the conveyer 149 over the input hopper 71 and then can be moved forward to allow the doors 144 to once again be closed.

After the supply truck 22 is empty, the roadway paving vehicle 20 can be decoupled from the supply truck 22 and linked with a second supply truck that is identical or similar to the first with a new supply of materials 14, 16, 17, and 19. This also can be done without stopping thereby providing a continuous operation. In practice, fixed location supply stations are often a far distance from the work area and therefore several supply trucks 22 are typically used.

Several additional advantages of the disclosed embodiment can be realized. One advantage is that in many circumstances the roadway 12 can receive traffic in less than four hours after surface treating, thereby minimizing traffic disturbance. The roadway paving vehicle 20 and supply truck 22 can also occupy one roadway lane, if desired, during surface treatment operations, thereby also minimizing traffic disturbance. The dimensions of the vehicle 20 and supply truck 22 are sized to be contained within a roadway. The surface treatment process can also operate with a greater viscosity range of asphalt binder material 14 and 17. This advantage can be realized due to the fact that aggregate material 16, additional binder 17, and finely graded material 19 can be discharged over the asphalt binder material 14 more quickly in a controlled manner.

The disclosed embodiment can achieve an application rate of about 10-900 square yards per minute, up to 24 tons per minute of aggregate 16 and 19 feed and about 10-400 gallons per minute of asphalt binder material 14 and 17. The roadway paving vehicle 20 can store between about 1 and 100 tons (and preferably between 30 and 25 tons, and even more preferably between 10 and 13 tons) of aggregate material 16 and 19 and has a total maximum tank holding capacity of binder 14 and 17 of 15,000 gallons (preferably a maximum of 2,000 gallons and even more preferably a maximum of 1,000 gallons). Yet a further advantage is that all of the vehicles 20 and trucks 22 of the disclosed embodiment are moving forward during surface treatment operations. This is in contrast to prior systems where the asphalt dispensing vehicle moved forwardly while the chip spreader moved in reverse to prevent wheels from rolling over asphalt binder material. Another advantage is that all of the layers, namely, layers 14, 16, 17 and 19 can be applied in a substantially synchronous process.

Successful retention of the aggregate 16 and 19 is dependent on the existing surface texture, aggregate dimensions, weather, and traffic conditions. Each of these affect the surface area of the aggregate 16 and 19 covered with asphalt binder 14 and 17. However, these variables are difficult to quantify. The advantage of the invention is that it significantly reduces the effect of these variables by putting some of the binder 17 on top of the aggregate 16 for better surface area bonding, minimizing the effect of existing surface texture, aggregate dimension, and aggregate cleanliness.

The application process of the present invention increases the surface area of the aggregate 16 and 19 covered with asphalt binder 14 and 17. Increasing the surface area of the aggregate 16 and 19 covered with asphalt binder 14 and 17 minimizes the effect of pavement surface texture, aggregate dimensions, and weather by making more contact points on the aggregate 16 and 19 covered with asphalt binder 14 and 17.

If the second application of asphalt binder 17 on top of the aggregate 16 is at least about 35% by volume of the total asphalt binder 14 and 17 applied in the chipseal process, the total application rate of binder 14 and 17 and aggregate 16 and 19 can each be as much as about 30% lower, and usually at least about 15% lower, than conventional chipsealing processes. The following table is an example of the advantages of the process of the invention compared with conventional processes:

TABLE 1

| Nominal | Quantity of Aggregate Pounds/Square Yard | | Quantity of Asphalt (gal/square yard) | |
|---|---|---|---|---|
| Aggregate Size | Conventional | Invention | Conventional | Invention |
| ½" | 25-30 | 16-22 | 0.45 | 0.35 |
| ⅜" | 20-25 | 13-18 | 0.35 | 0.25 |

Note that, in general, when using larger aggregate, application rates of both binder and aggregate increase. Excess fines on the aggregate 16 are less of an issue with the process of the present invention. This is advantageous because this will require less washing of the aggregate 16 before it is used.

The process of the present invention is especially advantageous for higher traffic areas where the road stays closed until all layers 14, 16, 17 and 19 have been applied. By using a quicker and possibly a substantially synchronous and continuous process and increasing coalescence rates with finely graded material 19 such as choke stone, the treated road surface can be released to traffic sooner.

By using less aggregate 16 and/or covering the aggregate 16 with remaining binder 17, less loose aggregate 16 remains. This is advantageous because it may reduce the need for the freshly treated surface to be swept. Having less loose material also reduces windshield and other vehicle damage.

In summary, the process of the present invention significantly improves aggregate retention. It also provides lower overall asphalt binder content and allows quicker return to traffic. Preferably, traffic is able to be on the newly treated road surface within an hour. Still further, softer asphalt can be used for longer life without causing bleeding conditions.

From the foregoing it will be seen that this invention is one well adapted to attain all ends and objectives herein-above set forth, together with the other advantages which are obvious and which are inherent to the invention.

While the invention has been described with a certain degree of particularity, it is manifest that many changes may be made in the details of construction and the arrangement of components without departing from the spirit and scope of this disclosure. It is understood that the invention is not limited to the embodiments set forth herein for the purposes of exemplification, but is to be limited only by the scope of the attached claim or claims, including the full range of equivalency to which each element thereof is entitled.

What is claimed is:

1. A method of applying a surface treatment to a road surface, comprising:

applying a first asphalt binder layer to said surface, distributing a first layer of aggregate over said first asphalt binder layer before said first asphalt binder layer substantially coalesces, substantially covering said first layer of aggregate with a second asphalt binder layer before said first asphalt binder layer substantially coalesces, and distributing a second layer of aggregate over said second asphalt binder layer before said second asphalt binder layer substantially coalesces.

2. A method of applying a surface treatment to a road surface according to claim 1 wherein the asphalt binder layers and aggregate layers are applied to the surface as a substantially synchronous process.

3. A method of applying a surface treatment to a road surface, according to claim 1 wherein the second layer of aggregate is finely graded material.

4. A method of applying a surface treatment to a road surface according to claim 3 wherein the asphalt binder layers and the aggregate layers are applied to the surface as a substantially synchronous process.

5. A method of applying a surface treatment to a road surface, according to claim 1 further comprising:

repeating the application of an additional first asphalt binder layer, an additional first aggregate layer, an additional second asphalt binder layer and an additional second aggregate layer on the same surface in less than 24 hours of the first application of first asphalt binder, first aggregate, second asphalt binder and second aggregate.

6. A method of applying a surface treatment to a road surface, according to claim 5 wherein the application of the additional layers of first asphalt binder, first aggregate, second asphalt binder and second aggregate on the same surface occurs within less than 12 hours of the first application of first asphalt binder, first aggregate, second asphalt binder and second aggregate.

7. A method of applying a surface treatment to a road surface, according to claim 5 wherein the application of the additional layers of first asphalt binder, first aggregate, second asphalt binder and second aggregate on the same surface occurs as a substantially synchronous process with the first application of first asphalt binder, first aggregate, second asphalt binder and second aggregate.

8. A method of applying a surface treatment to a road surface, comprising:

distributing a first aggregate layer on said surface, substantially covering said first aggregate layer with a first binder layer, and distributing a second aggregate layer over said first binder layer before said first asphalt binder layer substantially coalesces.

9. A method of applying a surface treatment to a road surface according to claim 8 wherein the first aggregate layer, the first binder layer and the second aggregate layer are applied to the surface as a substantially synchronous process.

10. A method of applying a surface treatment to a road surface, according to claim 8 further comprising:

substantially covering said second aggregate layer with a second binder layer before said first asphalt binder layer substantially coalesces.

11. A method of applying a surface treatment to a road surface according to claim 10 wherein the first aggregate layer, the first binder layer, the second aggregate layer and the second asphalt binder layer are applied to the surface as a substantially synchronous process.

12. A method of applying a surface treatment to a road surface according to claim 10 wherein said second aggregate layer is finely graded material.

13. A method of applying a surface treatment to a road surface according to claim 8 wherein said second aggregate layer is finely graded material.

14. Paving equipment comprising:

at least two means to apply binder provided on a paving vehicle for applying asphalt binder to a road surface to be treated;

at least two aggregate dispensing means also provided on said vehicle for distributing aggregate onto said surface, and one of said binder application means being located between adjacent aggregate dispensing means so that binder and aggregate are applied by the vehicle to the surface in alternating layers as the vehicle passes over the surface.

15. Paving equipment according to claim 14 further comprising:

each binder application system provided with independent control of distribution of binder, and each aggregate dispensing system provided with independent control of distribution of aggregate.

16. Paving equipment according to claim 15 further comprising:

means provided on said paving vehicle for releasably coupling with a supply truck that supplies binder and aggregate to said binder application means and said aggregate dispensing means, at least one supply truck, each supply truck provided with at least two tanks for supplying at least two binders to said paving vehicle, and said supply truck provided with separate hoppers for supplying at least two aggregates to said paving vehicle.

17. Paving equipment according to claim 16 further comprising:

a means for transferring aggregate being provided on each of the hoppers of the supply truck for the purpose of transferring aggregate from the hopper to one of the aggregate dispensing means of said paving vehicle.

18. Paving equipment according to claim 17 further comprising:

at least one of said means for transferring aggregate being extendable rearward from the supply truck for transferring aggregate from at least one of the hoppers of the supply truck to one of the aggregate dispensing means of said paving vehicle.

* * * * *